US005537085A

United States Patent [19]

McVeety

[11] Patent Number: 5,537,085

[45] Date of Patent: *Jul. 16, 1996

[54] INTERDIGITAL CERAMIC FILTER WITH TRANSMISSION ZERO

[75] Inventor: Thomas McVeety, Albuquerque, N.M.

[73] Assignee: Motorola, Inc., Schaumburg, Ill.

[ * ] Notice: The term of this patent shall not extend beyond the expiration date of Pat. No. 5,436,602.

[21] Appl. No.: 414,872

[22] Filed: Mar. 31, 1995

Related U.S. Application Data

[63] Continuation-in-part of Ser. No. 234,339, Apr. 28, 1994, Pat. No. 5,436,602.

[51] Int. Cl.[6] ..... H01P 1/205

[52] U.S. Cl. ..... 333/206; 333/207

[58] Field of Search ..... 333/202, 203, 333/204, 205, 206, 207, 222, 223

[56] References Cited

U.S. PATENT DOCUMENTS 5,150,089 9/1992 Komazaki et al. ..... 333/206
5,208,565 4/1993 Sogo et al. ..... 333/206
5,436,602 7/1995 McVeety et al. ..... 333/206

FOREIGN PATENT DOCUMENTS 293802 12/1991 Japan .

*Primary Examiner*—Benny Lee
*Assistant Examiner*—David H. Vu
*Attorney, Agent, or Firm*—Gary J. Cunningham

[57] ABSTRACT

A ceramic filter (10) is shown. The filter has a filter body of dielectric material, has top (14), bottom (16), and side surfaces (18, 20, 22 and 24), and further has metallized through holes extending from the top (14) to the bottom surface (16) defining resonators. A metallization layer substantially coats the top (14), bottom (16), and side surfaces (18, 20, 22 and 24), with the exception that a portion of one of the side surfaces is unmetallized in proximity to the bottom surface (16) and extends laterally between the resonators, defining a magnetic transmission line (32) for magnetically coupling alternate resonators. Also unmetallized are predetermined portions of the top and bottom surfaces which are alternately unmetallized, defining an interdigital configuration. Input-output couplings (34, 38) are included for coupling signals into and out of the filter. With this configuration, a desired frequency response can be obtained.

22 Claims, 9 Drawing Sheets

INTERDIGITAL CERAMIC FILTER WITH TRANSMISSION ZERO

CROSS REFERENCE TO RELATED APPLICATION

This application is a continuation-in-part of applicant's application Ser. No. 08/234,339 filed Apr. 28, 1994, which issued as U.S. Pat. No. 5,436,602 on Jul. 25, 1995.

FIELD OF THE INVENTION

This invention relates generally to filters, and in particular, to interdigital ceramic filters with a transmission zero.

BACKGROUND OF THE INVENTION

Filters are known to provide attenuation of signals having frequencies outside of a particular frequency range and little attenuation to signals having frequencies within the particular range of interest. As is also known, these filters may be fabricated from ceramic materials having one or more resonators formed therein. A ceramic filter may be constructed to provide a lowpass filter, a bandpass filter, or a highpass filter, for example.

For bandpass filters, the bandpass area is centered at a particular frequency and has a relatively narrow bandpass region, where little attenuation is applied to the signals. For example, the center frequency may be at 750 Megahertz (MHz) with a passband region of less than 2 MHz. While this type of filter may work well in some applications, it may not work well when a wider bandpass region is needed or under special circumstances when other characteristics are required.

Block filters typically use an electroded pattern printed on an outer (top) surface of the ungrounded end of the filter in a combline filter design. These top metallization patterns are typically screen printed on the ceramic block, which can be difficult and time consuming in the manufacturing process. Overall, the method of using a metallized pattern on one end of a combline filter can be both costly and labor intensive.

An alternative design technique involves eliminating the need to top print on the block by introducing chamfers into the block. Many block filters include chamfered resonator through-hole designs to facilitate and simplify the manufacturing process. The top chamfers help define the intercell couplings and likewise define the location of the transmission zero in the filter response. This type of design typically gives a response with a low side zero. To achieve a high side transmission zero response, chamfered throughholes are typically placed in the grounded end (bottom) of the ceramic block filter. Thus, a high zero response ceramic filter would typically have chamfers at both ends of the dielectric block. A double chamfer filter is more difficult to manufacture. This is due primarily to the tooling requirements and precise tolerances required in making double chamfered throughholes at the top and bottom surface of the filter. The use of a double chamfered design, like the top print design, is also difficult to manufacture, costly, and labor intensive.

A bandwidth of a filter can be designed for specific passband requirements. Typically, the wider the passband, the lower the insertion loss, which is an important electrical parameter. However, a wider bandwidth reduces the filter's ability to attenuate unwanted frequencies, typically referred to as the rejection frequencies. The addition of a transmission zero in the transfer function at the frequency of the unwanted signal could effectively improve the performance of a ceramic block filter as detailed below.

It would be considered an improvement in the art to provide an interdigital design which is easy to manufacture, requires fewer processing steps and still achieves a high side transmission zero using a very simple design. An interdigital ceramic filter which can be easily manufactured to manipulate and adjust the frequency response, preferably with a high side zero to attenuate unwanted signals, could improve the performance of a filter and would be considered an improvement in ceramic filters.

DETAILED DESCRIPTION OF THE PREFERRED EMBODIMENT

Figure 1A:
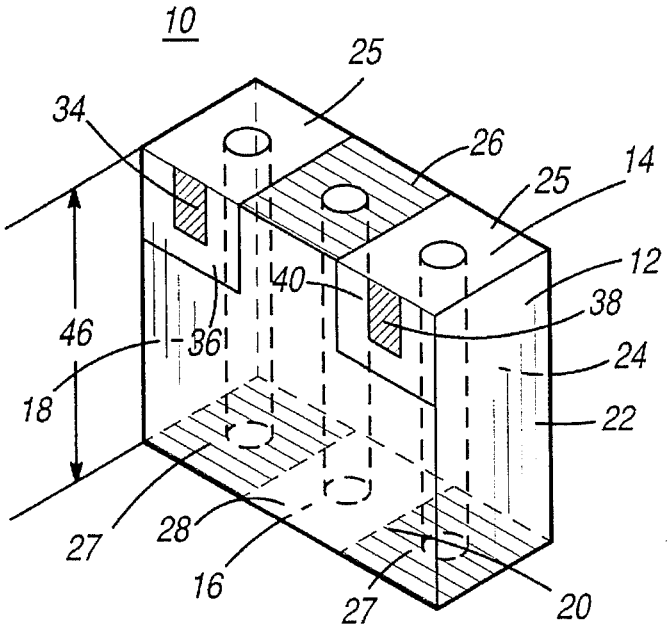
FIGS. 1A and 1B are enlarged, front and rear perspective views.
Figure 1C:
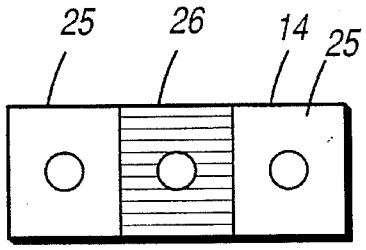
FIGS. 1C and 1D are top and bottom views of a three pole interdigital ceramic filter in accordance with the present invention.
Figure 1D:
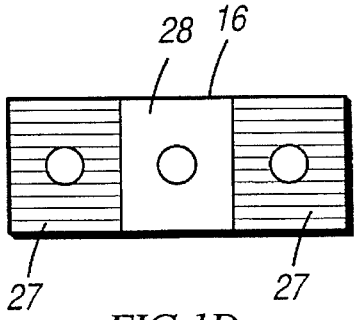
Figure 1B:
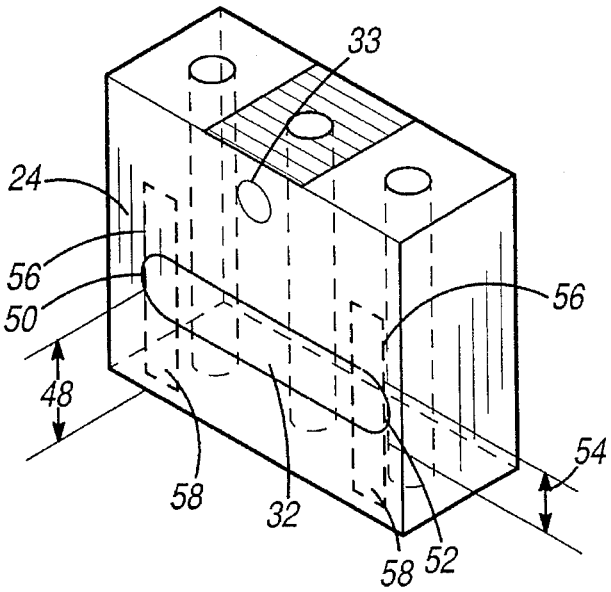

In FIGS. 1A and 1B, a three pole ceramic filter is shown which has a passband for passing a desired frequency and a transmission zero on the high side of the passband. The ceramic filter 10, includes a filter body 12 having a block of dielectric material and having top and bottom surfaces 14 and 16, and side surfaces 18, 20, 22 and 24. The filter body 12 has a plurality of through-holes extending from the top to the bottom surface 14 to 16 defining a first resonator 1, a second resonator 2, and a third resonator 3. The surfaces 18, 20, 22 and 24 are substantially covered with a conductive material defining a metallized exterior layer, with the exception that the top surface 14 and the bottom surface 16 are selectively metallized in the areas substantially surrounding the resonators defining an interdigital filter design.

More specifically, the three resonators include a top surface adjacent to a first and a third resonator being unmetallized 25 and a bottom surface adjacent to a second resonator which is unmetallized 28. In more detail, the interdigital design further includes a bottom surface 16 adjacent to a first and a third resonator being metallized 27 and a top surface adjacent to a second resonator which is metallized 26. With an interdigital design, each consecutive resonator is grounded at an opposite end of the block. Additionally, a portion of the side surface is substantially uncoated (comprising the dielectric material) in proximity to the bottom surface 16 and extending at least in proximity to between the resonators, defining a magnetic transmission line 32 for magnetically coupling the resonators.

The magnetic transmission line 32 (also referred to as an inductive transmission line, path or magnetic coupling), provides a magnetic coupling mechanism which inductively couples at least two alternate resonators in proximity to a grounded end, thereby providing a predetermined frequency response with a high side transmission zero. In one embodiment, the frequency response is substantially similar to that shown in FIG. 2.

The ceramic filter 10 also includes first and second input-output means, preferably in the form of pads 34 and 38 comprising an area of conductive material on at least one of the side surfaces and substantially surrounded by at least one or more uncoated areas 36 and 40 comprising the dielectric material.

The magnetic transmission line 32 can be tailored to accommodate a variety of different designs and configurations, while remaining within the teachings of the present invention. For example, the present invention contemplates an embodiment in which there is a magnetic transmission line 32 on both the front surface 20 and the rear surface 24 of the ceramic block filter. In a preferred embodiment, however, the magnetic coupling line 32 will be on the opposite surface of the block 20 which contains the input-output pads 34 and 38, to minimize the possibility of coupling into a circuit board after the block is surface mounted into an electronic device.

Another design variable involving the magnetic transmission line 32, is the possibility that two or more magnetic transmission lines may co-exist on the same side of the block. This may be desired to achieve a specific electrical frequency response. Also, the magnetic transmission line 32 may bend perpendicularly and extend in a direction which is parallel to the resonators, defining magnetic transmission line legs which will be detailed below. The ceramic filter can be made with a desired frequency response, with fairly simple modifications and changes, so long as the magnetic transmission line 32 is suitably positioned to provide the desired frequency characteristics.

The width of the magnetic transmission line is another design variable, as shown as item 54 in FIG. 1. The magnetic transmission line 32 includes a predetermined width sufficient to provide a suitable coupling. The width 54 is carefully chosen to provide the desired response. If the width is excessively wide or narrow, the desired frequency response will not be obtained because the magnetic or inductive coupling will be too high or low, for example.

In one embodiment, the width is about one third of L or less, preferably about ⅙ L or less, for the desired response (L is defined as the distance from the top to the bottom surface 14 to 16). In one embodiment, unmetallized upwardly extending legs 56 and/or downwardly extending legs 58 may be included having similar widths, for providing a desired frequency response. Stated another way, the width 54 can be about 30 degrees wide, and preferably about 25 degrees wide for a desired response in a quarter wave filter. The width 54 can be used to adjust and compensate for small manufacturing deviations, if necessary. Thus, the dimensions and placement of the magnetic transmission line 32 are important features to accurately position the transmission zero, to obtain the desired frequency response of the filter, and can also be used to compensate for minor manufacturing deviations.

In the present invention, the desired magnetic activity occurs within about 40 degrees of the grounded end of the filter block. Thus, the magnetic transmission line 32 will preferably be placed in this (high magnetic activity) region of the block. If the magnetic transmission line were placed in the area about 40 to 50 degrees from the grounded end of the block, the magnetic activity is too low, and the magnetic transmission line 32 would not serve its intended purpose. Avoiding this region of low magnetic activity is thus preferred.

The significance of using the magnetic transmission line 32 as a design variable cannot be understated. By using a larger void (unmetallized) area to make up the transmission line 32, comprising substantially only the dielectric material (unmetallized), a larger magnetic transmission line having a higher inductive value is attainable. More energy may be coupled between the resonators in this structure, which allows the transmission zero to be adjustable.

The present invention can encompass various types of transmission line designs, wherein magnetic coupling is achieved through the removal of conductive material between alternate resonators. Thus, the magnetic coupling transmission line 32 can be substantially rectangular or oval in shape, if desired.

By careful placement of line 32, a desired response can be defined more easily and substantially independent of the initial manufacture of the ceramic filter, than without the transmission line 32. Stated another way, the structure of filter 10 is adapted to allow a manufacturer to make a generic type of ceramic filter, and at a later time, can easily modify and manipulate the frequency response, and in turn provide different models exhibiting various specified responses, by including the transmission line 32, which is advantageous from a manufacturing point of view.

The ceramic filter 10 includes a predetermined length L, identified as item 46, which is defined as the distance from the top to the bottom surface 14 to 16 of the block. The magnetic transmission line 32 is located substantially at one end of the filter block which is determined by the interdigital design, and between and substantially parallel to the top and bottom surfaces 14 and 16. The distance from the end of the block to the magnetic transmission line 32 is identified as item 48 in FIG. 1.

Figure 2:
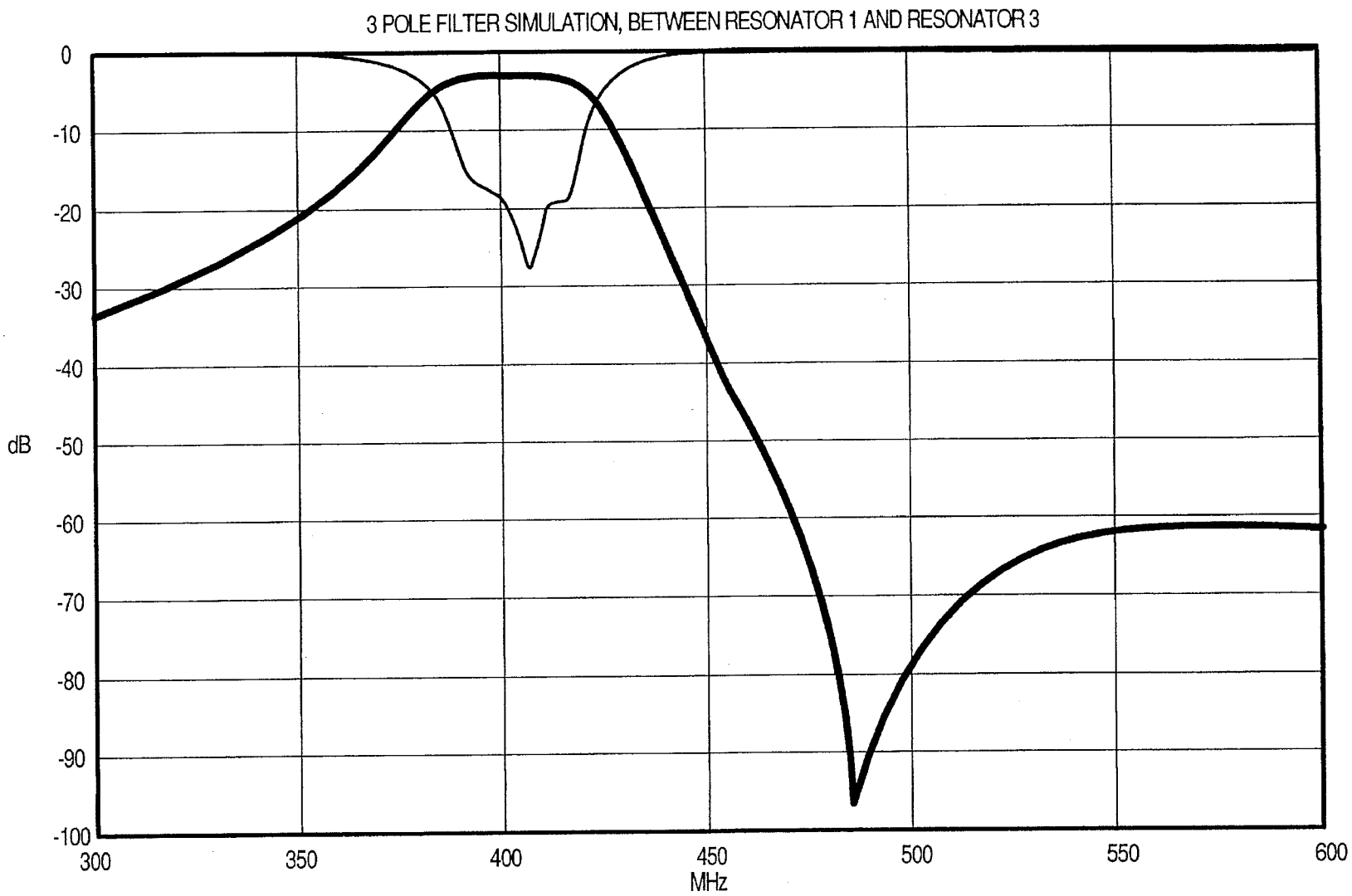
FIG. 2 is a graph of a simulated electrical frequency response curve for the filter shown in FIG. 1, in accordance with the present invention.

The transmission line 32 location is suitably positioned in the area of high magnetic activity of the filter 10, as detailed herein. If the location were at the center of the block, for example, the transmission line (void) would typically serve little or a minimal purpose, other than to change the intercell coupling. However, if properly positioned as detailed herein, and considering the structure, size, dielectric value of the ceramic block, spacing between the resonators, etc., a desired frequency response can be achieved, substantially as shown in FIG. 2. On the other hand, if the location of the magnetic transmission line 32 is placed too low on the block (or exceedingly near the bottom surface 16), the resonators can be detuned to a lower resonant frequency and may be more difficult to control.

The filter body may be considered a quarter wavelength filter, including about 90 degrees from the bottom surface to the top surface. The magnetic transmission line 32 may be positioned from about 40 degrees to about 10 degrees from the bottom surface 16. Alternatively, other embodiments may employ a variety of means to define the position of the magnetic transmission line 32 on a surface of the block.

The positioning of the magnetic transmission line 32 is, by necessity, in the area of magnetic activity of the filter 10. In a combline design, substantially most of the magnetic activity takes place at or in proximity to the grounded end, that is in proximity to the bottom surface 16, of the filter block. For an interdigital filter, this is not necessarily true. For an interdigital filter, substantially all of the magnetic activity takes place at an end where two alternate resonators are grounded. Depending on the metallization pattern on the top and bottom surfaces 14 and 16 of block 10, this may occur at either end of the block. In a preferred embodiment shown in FIG. 1, the bottom surface 16 near the first and third resonators is metallized defining a grounded end of those resonators, i.e., 1 and 3. Consequently, the area of greatest magnetic activity is near the bottom surface 16 of the block. As detailed above, it follows that the magnetic transmission line 32 is located on rear surface 24 of the block, near the bottom end of the block. Stated another way, it is the grounded metallization pattern at the end of the resonators which determines the location of the magnetic transmission line 32. Of course, the metallization pattern will depend on the number of resonators in the filter block.

However, if the first and third resonators 1 and 3 were grounded on the top surface of the block, the magnetic transmission line 32 would also be located near the top surface of the block. Therefore, the magnetic transmission line 32 is strategically positioned in a predetermined region of high magnetic activity, to have a positive influence over the frequency response, and preferably with the placement of the transmission zero on the high side of the passband.

Referring to FIG. 2, a graph of a simulated electrical frequency response for the filter shown in FIG. 1 is shown. By placing a magnetic transmission line 32 at a suitable location, a response curve like that shown in FIG. 2 (having a high zero response), can be obtained. By using a larger void to make up transmission line 32, a larger magnetic transmission line having a higher inductive value is attainable. More energy may be coupled between the resonators in this structure, which allows the transmission zero to be adjustable.

By placing a zero at a desired frequency, greater attenuation at that frequency may be obtained, than otherwise would be possible given the same number of poles. This is at the expense of the opposite side attenuation. However, this is usually not a deterrent, as the increased single sided attenuation is usually more desirable than simply symmetrical rejection, for many applications. To achieve this amount of attenuation, a greater number of poles would usually be required, at additional expense and at the cost of additional physical size. The fact that the high side zero in the filter 10 is tunable or controllable, increases its relative worth, because then a single general design can be easily modified to specific requirements.

In addition to these advantages, the bandwidth of the block filter 10 can be adjusted or increased, with improved insertion loss, and without degrading the attenuation. A high side transmission zero helps to provide for more versatility of block filters, and modifications to external surfaces can be made fairly easily, without significant additional costs.

Figure 3:
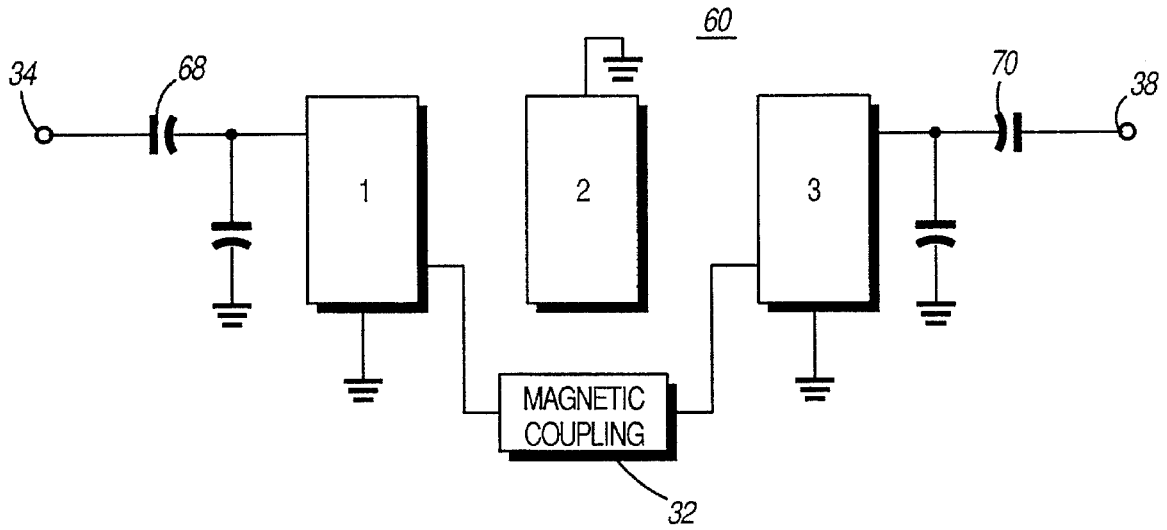
FIG. 3 is a simplified equivalent circuit diagram of the ceramic filter shown in FIG. 1, in accordance with the present invention.

FIG. 3 shows an equivalent simplified circuit diagram for the filter shown in FIG. 1. The circuit diagram 60, has an input and output, designated as 34 and 38. The first, second, and third resonators are shown as items 1, 2, and 3, respectively. The circuit diagram 60 shows that the input 34 is coupled to resonator 1 via capacitor 68. Similarly, the output 38 is connected to resonator 3 via capacitor 70. Capacitors 68 and 70 are substantially defined by the distance between the input-output pads 34 and 38 and their respective resonators 1 and 3 in FIG. 3.

Connected between resonator 1 and resonator 3 is a magnetic transmission line 32 (for magnetic coupling these resonators), which can be shown as a variable inductance. The value of the magnetic transmission line 32 is defined by its overall dimensions and geometry. The line 32 includes a vertical width component 54 and a predetermined lateral distance between a first and a second end portion, 50 and 52 in FIG. 1.

The magnetic transmission line 32 can also be considered as an inductive transmission line or path, comprising unmetallized dielectric material on the front input-output pad side of the block 20, on the rear side of the block 24, or on both sides of the block 20 and 24. Preferably, the transmission line 32 will be in a position for easy access. The transmission line 32 couples at least two alternate resonators, such as the input and output resonators 1 and 3 shown in FIG. 1 to provide a desired frequency response. The inductive transmission line (path) 32 couples the input and output resonators 1 and 3 in proximity to the grounded ends 27 thereof, where most of the magnetic energy exists, thereby taking advantage of the magnetic energy in this area.

Each resonator 1, 2, and 3 includes a grounded end coupled to the ground plane and an ungrounded end. The inductive transmission line 32 comprises a substantially unmetallized (non-conductive) dielectric material, having a predetermined lateral length sufficient to couple the input and output resonators 1 and 3 and a predetermined width to provide the desired inductive path.

The transmission line 32 is specially configured to provide a good magnetic coupling of the grounded ends 27 of resonators 1 and 3. In a preferred embodiment, the transmission line 32 has first 50 and second 52 lateral areas which couple, connect, overlap and intersect with resonators 1 and 3 and the adjacent grounded ends 27 of resonators 1 and 3, to provide the desired magnetic coupling. The transmission line 32 has a width sufficient to provide a magnetic coupling to the grounded ends 27 of resonators 1 and 3 to obtain the desired frequency response.

in one embodiment, the frequency response of the filter can be further controlled by the introduction of magnetic (unmetallized) transmission line legs 56 (in dashed line) onto the ends of the magnetic transmission line 32. The magnetic transmission line legs 56 can be considered to bend substantially perpendicularly near the coupled resonators and extend substantially upwardly in the direction of the top of the block. This feature (legs 56) provides more control of the frequency response curve by fine tuning the magnetic coupling between the resonators. This feature can be added to the magnetic transmission line 32 in any embodiment shown in the figures. Similarly, downwardly extending legs 58 can be included as well. In one embodiment, both legs 56 and 58 are included, to provide the desired response.

In a preferred embodiment, the width of line 32 is sufficient to place the transmission zero at the desired location in the frequency response curve. Generally, the wider the width, the lower the impedance provided by line 32, which decreases (or lowers) the zero in frequency. In a preferred embodiment, the width is configured to suitably place the transmission zero at the appropriate position, above the passband similar to as shown in FIG. 2. As should be understood by those skilled in the art, various modifications of the transmission line 32 and filters 10, 110, and 210 can be made by those skilled in the art, without departing from the teachings detailed herein.

The geometry (combination of the length and width) of the transmission line can contribute to determining the magnetic coupling impedance of the inductive transmission line 32. As the width is increased, the amount of magnetic coupling is correspondingly increased, thereby decreasing the impedance and causing the zero to move lower in frequency.

The magnetic transmission line 32 defines an inductive path substantially isolated from the uncoupled resonator, or the middle resonator 2 in FIG. 1. Minimal or substantially no magnetic interaction occurs between the inductive transmission line 32 and the ungrounded end 28 of the middle resonator 2, because there is minimal or practically no magnetic energy at the ungrounded end 28 of the middle resonator 2.

Figure 4:
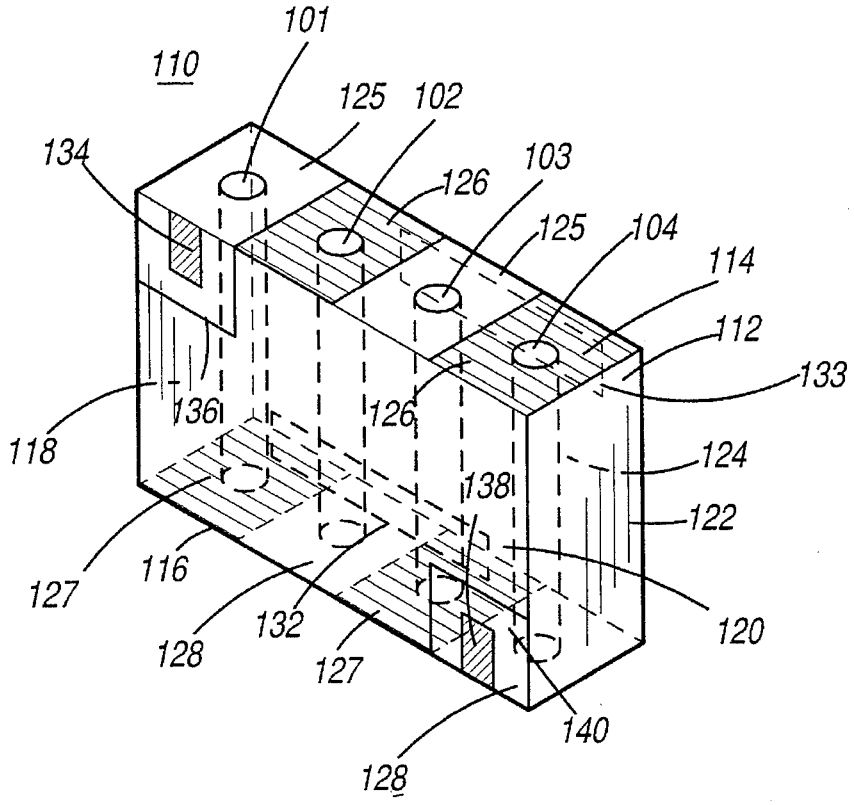
FIG. 4 is an enlarged, perspective view of a four pole interdigital ceramic filter, in accordance with the present invention.

The transmission line 32 comprises essentially a lateral void in the ground plane, which allows magnetic energy to substantially freely flow between the alternate resonators 1 and 3, because there is magnetic energy in the region of the grounded ends 27 of the resonators 1 and 3. Similarly, in a four pole block filter as shown in FIG. 4, the same is true regarding the coupling of the grounded ends of the resonators. The magnetic coupling between the ungrounded end 28 of the middle resonator 2 and the grounded ends 27 of the end resonators 1 and 3 is minimal, as detailed above, because only a minimal amount of magnetic energy is present in proximity to the ungrounded end 28 of resonator 2. More particularly, the transmission line 32 and the grounded end 26 of the middle resonator 2 are sufficiently spaced at a predetermined distance, and suitably isolated to minimize unwanted coupling and output frequency response.

Stated another way, the transmission line 32 (or path) is substantially uncoupled to the middle resonator 2, and carefully placed about 40 degrees or less from the ground 27 of resonators 1 and 3, preferably about 10 degrees to about 40 degrees from the ground 27 of resonators 1 and 3, for the desired response.

The transmission line 32 can be formed in a variety of ways, such as by masking in an electroding process, milling, dremmeling, laser-etching, grinding or the like, to suitably form the desired configuration of transmission line 32 (defined by the non-conductive dielectric alone).

Figure 7:
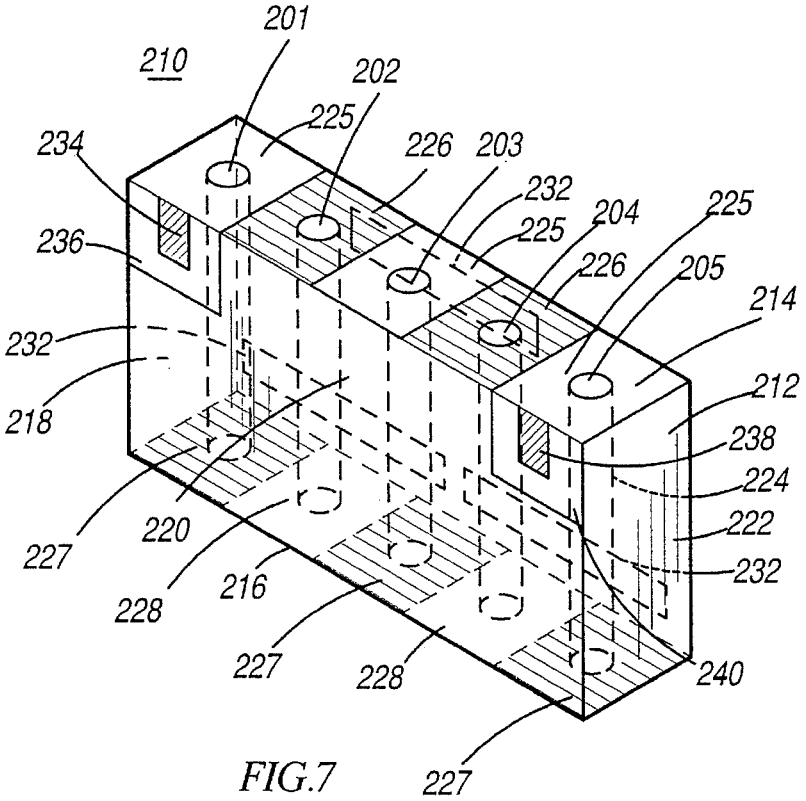
FIG. 7 is an enlarged, perspective view of a five pole interdigital ceramic filter, in accordance with the present invention.

In the filters 10, 110, and 210 shown in FIGS. 1, 4, and 7, it is desirable that the resonant frequencies of the resonators be approximately similar, for improved performance of the filter.

Referring to FIG. 1, an additional tuning technique may be desirable on the outer surface of the block. If the three resonators 1, 2, and 3 are substantially similar in length, a portion of the ground plane or conductive material in proximity to and adjacent to the grounded end 26 of the middle resonator 2 can be removed on surface 24 (hereafter referred to as a tuned area 33 in FIG. 1 ), thereby tuning and lowering the frequency of the middle resonator 2, to approach the resonant frequencies of the other resonators 1 and 3.

This tuning technique can result in a filter with a desired frequency response, such as a bell shaped curve with an improved lower insertion loss. The transmission line 32 tends to lower the frequency of the inner and outer resonators 1 and 3. To obtain the desired frequency response, tuning of the middle resonator 2 is recommended, preferably by removing some conductive material in tuned area 33, to obtain a frequency response, as shown in FIG. 2, for example.

As illustrated in FIG. 4, a four pole high zero interdigital block filter is shown. The ceramic filter 110, includes a filter body 112 having a block of dielectric material and having top and bottom surfaces 114 and 116 and side surfaces 118, 120, 122 and 124. The filter body has a plurality of through-holes extending from the top surface to the bottom surface 114 to 116 defining a first resonator 101, a second resonator 102, a third resonator 103, and a fourth resonator 104.

The surfaces 118, 120, 122 and 124 are substantially covered with a conductive material defining a metallized exterior layer, with the exception that the top surface 114 and the bottom surface 116 are selectively metallized in the areas substantially surrounding the resonators defining an interdigital filter design. More specifically, top surface 114 adjacent to a first and a third resonator 101 and 103 are unmetallized 125, and a bottom surface 116 adjacent to a second 102 and a fourth resonator 104 are unmetallized 128. To complete the interdigital design, the bottom surface 116 adjacent to a first and a third resonator 101 and 103 are metallized 127, and the top surface adjacent to the second and a fourth resonator 104 are metallized 126.

Additionally, a portion of one of the side surfaces is substantially uncoated (comprising the dielectric material) in proximity to one of the ends of the block, and extends at least in proximity to between alternate resonators, defining a magnetic transmission line 132 for magnetically coupling the resonators. The ceramic filter 110 also includes first and second input-output means, and preferably in the form of pads 134 and 138 comprising an area of conductive material on at least one of the side surfaces and substantially surrounded by at least one or more uncoated areas 136 and 140 of the dielectric material.

In this embodiment, the input-output pads 134 and 138 are offset on opposite ends of the block. This is necessary because the input-output pads are located near the non-grounded ends of their respective resonators to achieve maximum electrical coupling. In the four-pole resonator design in FIG. 4, the first resonator 101 and the fourth resonator 104 are grounded at opposite ends of the block filter 110, thus requiring the input-output pads to be offset at opposite ends of the block.

The magnetic transmission line 132 may be located on the front surface of the block 120, on the rear surface of the block 124, or on both the front and rear surfaces of the block as design parameters dictate. However, in a preferred embodiment, only a single magnetic transmission line 132 is placed on the rear surface 124 opposite to the surface 120 containing the input-output pads 134 and 138.

The magnetic transmission line 132 can be varied, as discussed with respect to FIG. 1, to achieve maximum design flexibility. In this embodiment, the magnetic transmission line 132 may extend laterally at least in proximity to the first and third resonators or it may extend laterally in proximity to the second and fourth resonators, shown as item 133 in FIG. 4. The four pole interdigital block filter 110 can lead to a product which is easier to manufacture, and require less processing steps, than conventional four pole ceramic block filters.

Figure 5:
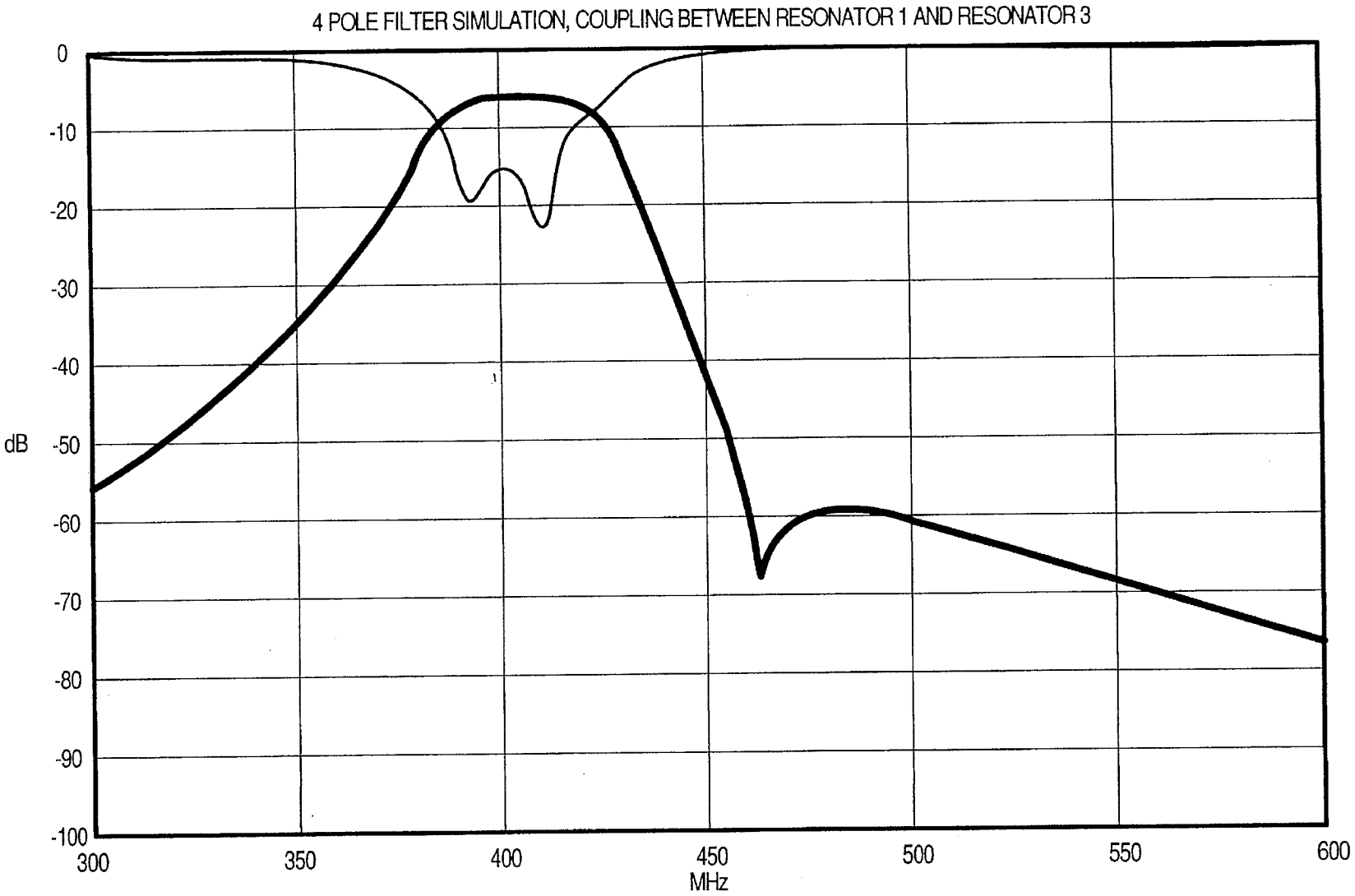
FIG. 5 is a graph of a simulated electrical frequency response curve for the filter shown in FIG. 4, in accordance with the present invention.

FIG. 5 shows a representative (simulated) graph of the electrical frequency response curve for the filter 110 shown in FIG. 4. As can be seen from this graph, a four pole filter can offer improved ultimate attenuation, generally at the expense of increased insertion loss. The transmission zero provided in filter 110 effectively adds, at little or no cost, an additional pole of filtering, for obtaining a desired frequency response similar to that shown in FIG. 5.

Increasing the number of poles in a ceramic block filter can have a significant effect on the electrical frequency response curve. Ordinarily, by adding more poles to the filter, the ultimate attenuation is increased. Thus, a four pole filter will ordinarily have greater attenuation than a three pole filter, all other variables being the same. It will follow, therefore, that a five or more pole filter such as the one shown in FIG. 7 will exhibit even greater attenuation than a four pole filter.

Another effect of increasing the number of poles in a filter involves the shape of the frequency response. Generally, as the number of poles increases, the profile of the response curve about the center frequency will narrow. Stated another way, the slope of the curve will increase as the number of poles increases. This is typically more desirable from a designer's point of view. Consequently, the shape of the frequency response curve can be varied for various electronic applications.

Figure 6A:
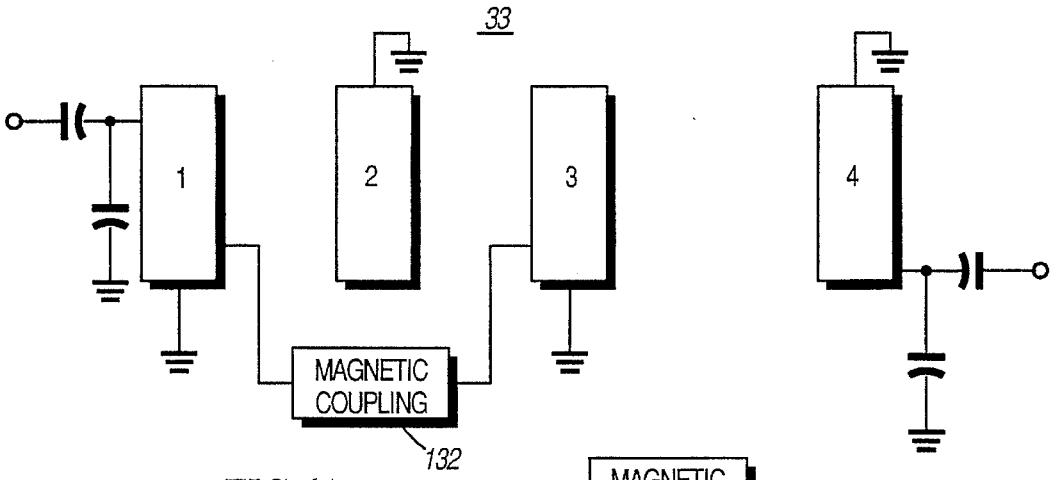
FIGS. 6A and 6B are a simplified equivalent circuit diagrams of the ceramic filter shown in FIG. 4, in accordance with the present invention.
Figure 6B:
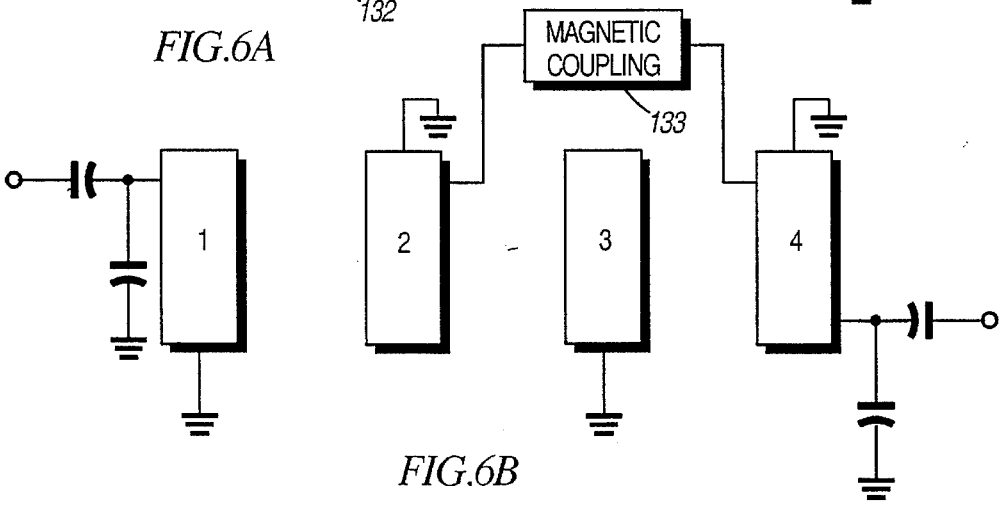

FIG. 6 shows a simplified equivalent circuit diagram for the filter shown in FIG. 4. This schematic is substantially similar to the schematic in FIG. 3. However, this schematic further shows how the magnetic transmission line 32 may be located in various positions on the block surface (i.e., coupling resonators 1 and 3 or 2 and 4), depending upon the configuration of the resonators.

In FIG. 7, a five pole high zero interdigital block filter is shown. The ceramic filter 210, includes a filter body 212 having a block of dielectric material and having top and bottom surfaces 214 and 216 and side surfaces 218, 220, 222, and 224. The filter body has a plurality of through-holes extending from the top surface to the bottom surface 214 to 216 defining a first resonator 201, a second resonator 202, a third resonator 203, a fourth resonator 204 and a fifth resonator 205.

The surfaces 218, 220, 222 and 224 are substantially covered with a conductive material defining a metallized exterior layer, with the exception that the top surface 214 and the bottom surface 216 are selectively metallized in predetermined areas substantially surrounding the resonators defining an interdigital design. More specifically, the interdigital filter 210 includes a top surface 214 adjacent to a first, a third and a fifth resonator being unmetallized 225, and a bottom surface 216 adjacent to a second and a fourth resonator which is unmetallized 228. To complete the interdigital design, it follows that the bottom surface 216 adjacent to a first, a third and a fifth resonator is metallized 227, and a top surface 214 adjacent to the second 202 and the fourth resonator 204 is metallized 226.

Additionally, a portion of the side surface is substantially uncoated (comprising the dielectric material) in proximity to one of the ends of the block and extends at least in proximity to between alternate resonators, defining a magnetic transmission line 232 for magnetically coupling the resonators. The ceramic filter 210 also includes first and second input-output means, preferably in the form of pads 234 and 238 comprising an area of conductive material on at least one of the side surfaces and substantially surrounded by at least one or more uncoated areas 236 and 240 of the dielectric material.

The magnetic transmission line 232 may be located on the front surface 220, the rear surface 224, or on both the front and rear surfaces 220 and 224, as design parameters dictate. However, in a preferred embodiment, only a single magnetic transmission line 232 is placed on the rear surface 224 opposite to the front surface 220 containing the input-output pads 234 and 238.

The magnetic transmission line 232 can be varied, as detailed in FIGS. 1 and 4, to achieve maximum design flexibility. In this embodiment, the magnetic transmission line may extend laterally at least in proximity to the first 201 and third resonators 203, the second 202 and the fourth resonators 204, or the third 203 and fifth resonators 205.

Figure 8A:
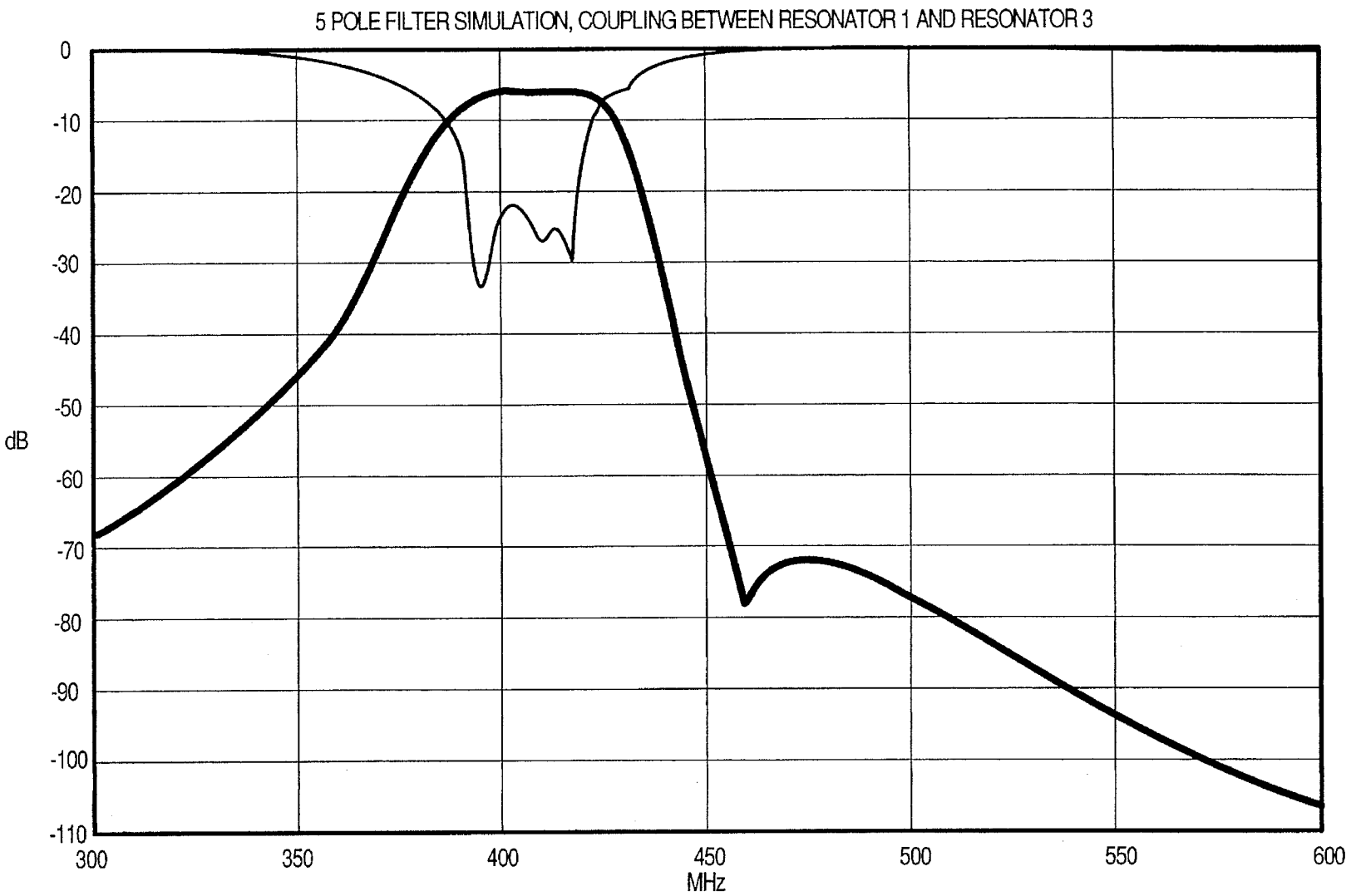
FIGS. 8A–8C are graphs of a simulated electrical frequency response curve for the filter shown in FIG. 7, in accordance with the present invention.
Figure 8B:
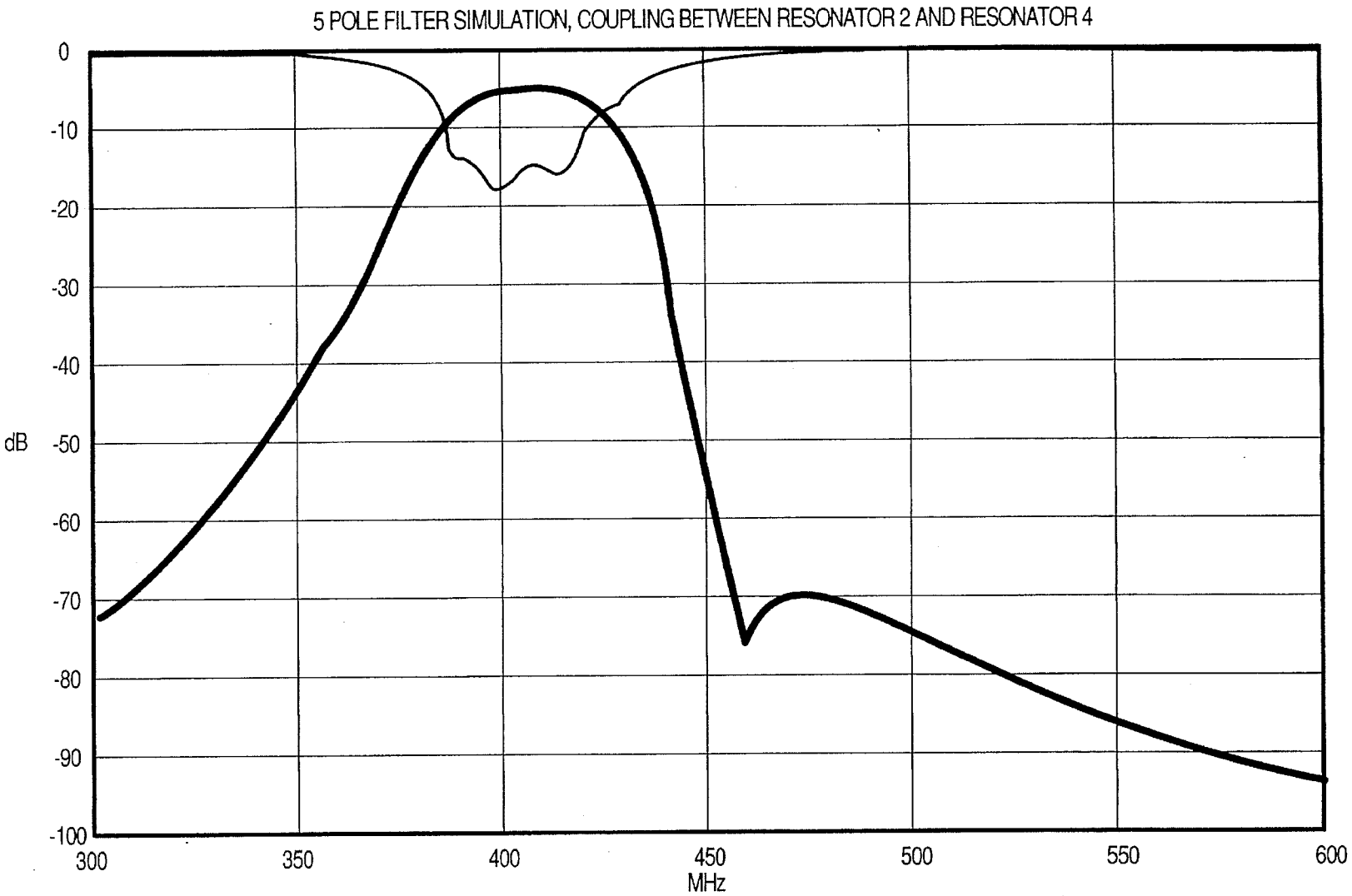
Figure 8C:
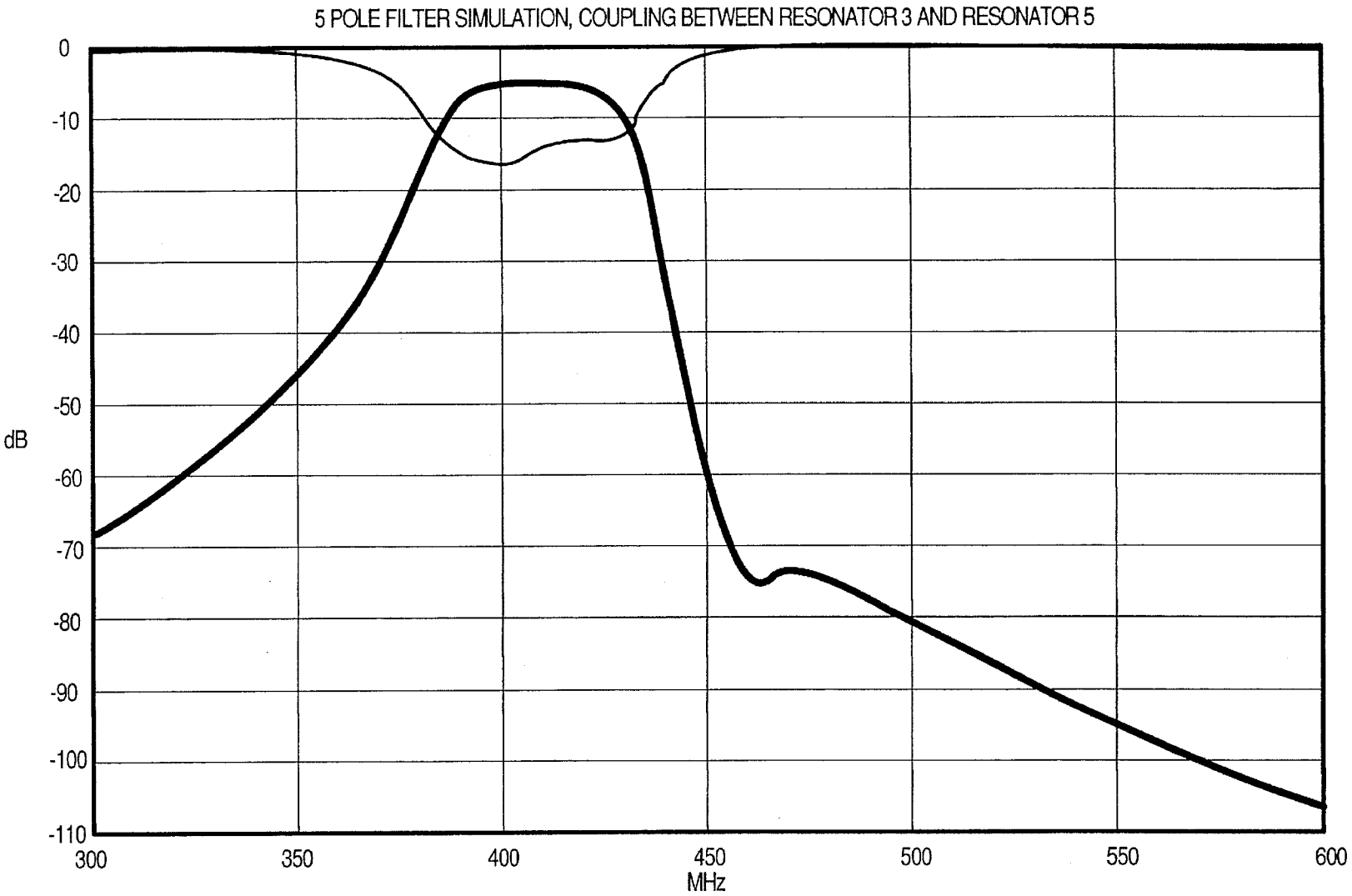
Figure 9A:
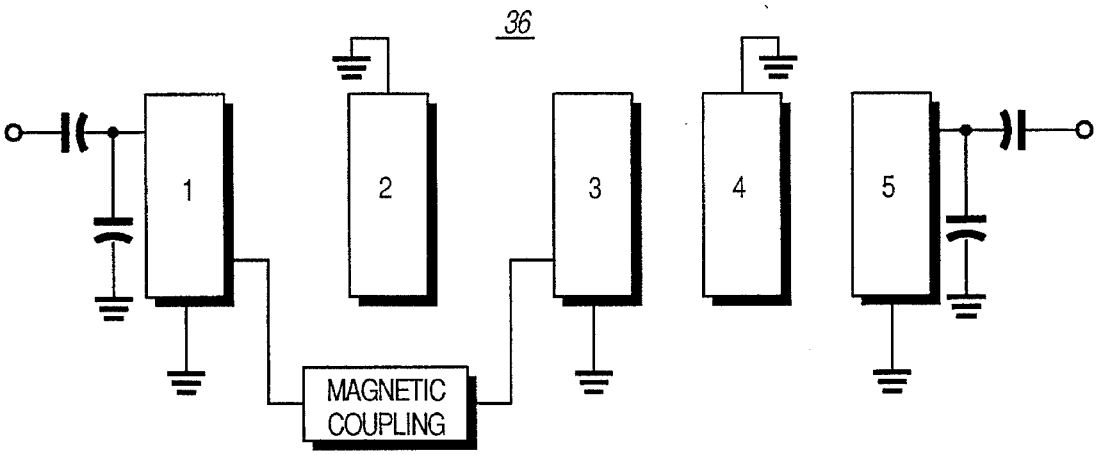
FIGS. 9A, 9B, and 9C are an equivalent circuit diagrams of the ceramic filter shown in FIG. 7, in accordance with the present invention.
Figure 9B:
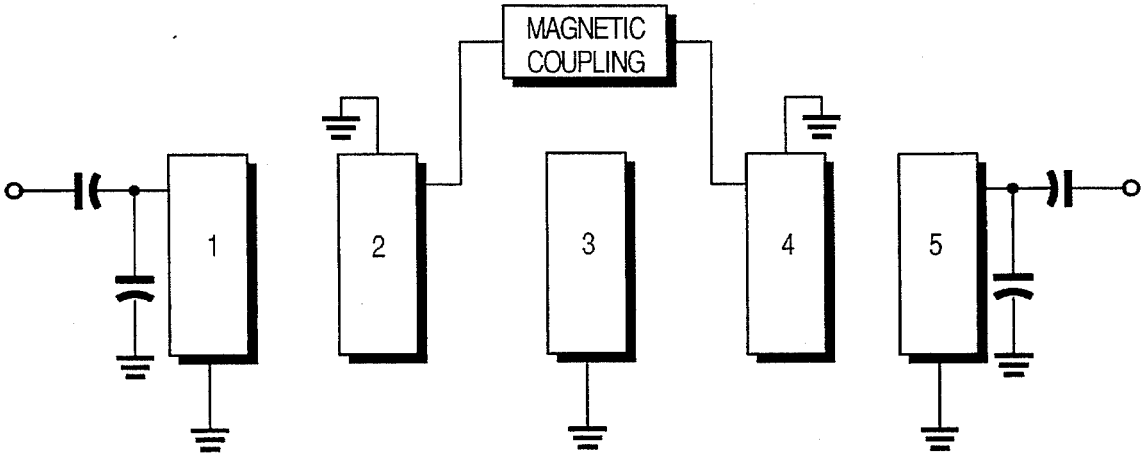
Figure 9C:
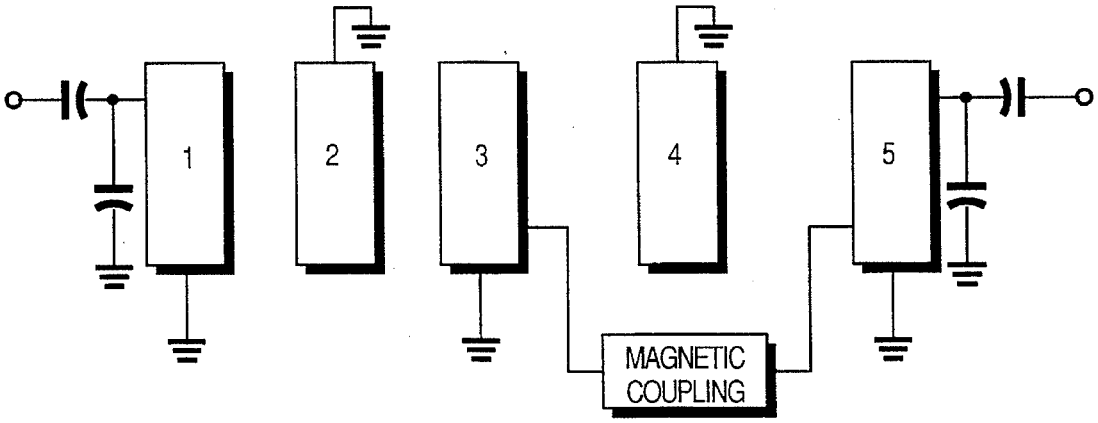

FIGS. 7 and 8 show the electrical frequency response curves and simplified equivalent circuit diagrams for the five pole filter shown in FIG. 6. The five pole filter will have the greatest attenuation of the embodiments shown. However, the other characteristics and properties will be substantially similar to the other filters 10 and 110 discussed previously.

Although the present invention has been described with reference to certain preferred embodiments, numerous modifications and variations can be made by those skilled in the art without departing from the novel spirit and scope of this invention.

What is claimed is:

1. A ceramic filter including a passband for passing a desired frequency response and at least one transmission zero, comprising:

a filter body comprising a block of dielectric material and having top, bottom, and side surfaces, and having a plurality of metallized through holes extending from the top to the bottom surface defining resonators, a metallization layer substantially coating the top, bottom, and side surfaces, with the exception that a portion of at least one of the side surfaces is unmetallized in proximity to the bottom surface and extends laterally between the resonators, defining a magnetic transmission line for magnetically coupling alternate resonators;

and with an additional exception that predetermined portions of the top and bottom surfaces are alternately unmetallized defining an interdigital configuration;

the interdigital configuration having at least an area in proximity to a first and a second resonator unmetallized on the top surface and the bottom surface, respectively; and first and second input-output pads comprising an area of conductive material on one of the side surfaces and substantially surrounded by an unmetallized area.

2. The filter of claim 1, wherein the filter includes a predetermined length L, defined as the distance from the top to the bottom surface, and the magnetic transmission line is located below an area about one half way between the top and bottom surface.

3. The filter of claim 1, wherein there are at least three resonators and the magnetic transmission line extends substantially laterally at least in proximity to a first and a third resonator.

4. The filter of claim 3, wherein the magnetic transmission line has lateral terminations which extend longitudinally substantially perpendicularly from the bottom in proximity to the resonators and extend substantially in a direction toward at least one of the top and the bottom of the block.

5. The filter of claim 1, wherein there are at least four resonators and the magnetic transmission line extends substantially laterally at least in proximity to a first and a third resonator.

6. The filter of claim 1, wherein there are at least four resonators and the magnetic transmission line extends substantially laterally at least in proximity to a second and a fourth resonator.

7. The filter of claim 1, wherein there are at least five resonators and the magnetic transmission line extends substantially laterally at least in proximity to a first and a third resonator.

8. The filter of claim 1, wherein there are at least five resonators and the magnetic transmission line extends substantially laterally at least in proximity to a second and a fourth resonator.

9. The filter of claim 1, wherein there are at least five resonators and the magnetic transmission line extends substantially laterally at least in proximity to a third and a fifth resonator.

10. The filter of claim 1, further comprising a transmission line located opposite from the magnetic coupling region, to provide additional control of the placement of the zero.

11. The filter of claim 1, wherein the first and second input-output pads are inductively coupled to the resonators.

12. The filter of claim 1, wherein the magnetic transmission line is located on one side and the input-output pads are located on the other side.

13. The filter of claim 1, wherein the magnetic transmission line extends between alternate resonators.

14. The filter of claim 13, wherein the magnetic coupling transmission line is substantially rectangular in shape.

15. The filter of claim 13, wherein the magnetic coupling transmission line is substantially oval in shape.

16. The filter of claim 1, wherein the filter body comprises a quarter wavelength filter including about 90 degrees from the bottom surface to the top surface, and the unmetallized portion is positioned from about 40 degrees to about 10 degrees from the bottom surface.

17. The filter of claim 1, further comprising a second magnetic transmission line on a surface of the block opposite the magnetic transmission line.

18. The filter of claim 1, wherein there are three resonators including a top surface adjacent to a first and a third resonator being unmetallized and a bottom surface adjacent to a second resonator which is unmetallized.

19. The filter of claim 1, wherein there are four resonators including a top surface adjacent to a first and a third resonator being unmetallized and a bottom surface adjacent to a second and a fourth resonator which is unmetallized.

20. The filter of claim 1, wherein there are five resonators including a top surface adjacent to a first, a third and a fifth resonator being unmetallized and a bottom surface adjacent to a second and a fourth resonator which is unmetallized.

21. A ceramic filter including a passband for passing a desired frequency response and at least one transmission zero, comprising, a filter body comprising a block of dielectric material and having top, bottom, and side surfaces, and having a plurality of metallized through holes extending from the top to the bottom surface defining resonators.

a metallization layer substantially coating the top, bottom, and side surfaces, with the exception that a portion of at least one of the side surfaces is unmetallized in proximity to the bottom surface and extends laterally between the resonators with longitudinally extending leg portions in proximity to and substantially parallel to the resonators, defining a magnetic transmission line for magnetically coupling alternate resonators, and with an additional exception that predetermined portions of the top and bottom surfaces are alternately unmetallized defining an interdigital configuration.

the interdigital configuration having at least an area in proximity to a first and a second resonator unmetallized on the top surface and the bottom surface respectively; and first and second input-output pads comprising an area of conductive material on one of the side surfaces and substantially surrounded by an unmetallized area.

22. A ceramic filter including a passband for passing a desired frequency response and at least one transmission zero, comprising:

a filter body comprising a block of dielectric material and having top, bottom, and side surfaces, and having three metallized through holes extending from the top to the bottom surface defining first, second, and third resonators;

a metallization layer substantially coating the top, bottom, and side surfaces, with the exception that a portion of at least one of the side surfaces is unmetallized in proximity to the bottom surface and extends laterally between the first and third resonators, defining a magnetic transmission line for magnetically coupling the first and the third resonators;

and with an additional exception that predetermined portions of the top and bottom surfaces are alternately metallized defining an interdigital configuration;

the interdigital configuration having an area in proximity to the first and the third resonator unmetallized on the top surface and having an area in proximity to the first and the third resonator metallized on the bottom surface, and the interdigital configuration further having an area in proximity to the second resonator metallized on the top surface and having an area in proximity to the second resonator unmetallized on the bottom surface; and first and second input-output means for coupling signals into and out of the filter.

* * * * *